US007208461B2

(12) United States Patent
Casey et al.

(10) Patent No.: US 7,208,461 B2
(45) Date of Patent: Apr. 24, 2007

(54) DETERGENT COMPOSITIONS

(75) Inventors: Siobhan Casey, Wirral (GB); Philip Ronald Moore, Wirral (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 141 days.

(21) Appl. No.: 10/726,738

(22) Filed: Dec. 3, 2003

(65) Prior Publication Data

US 2004/0110658 A1 Jun. 10, 2004

(30) Foreign Application Priority Data

Dec. 7, 2002 (GB) ..... 0228585.6

(51) Int. Cl.
*C11D 17/00* (2006.01)

(52) U.S. Cl. ..... 510/446; 510/426; 510/428; 510/492; 510/495; 510/498; 510/509

(58) Field of Classification Search ..... 510/141, 510/152, 155, 444, 445, 447
See application file for complete search history.

(56) References Cited

U.S. PATENT DOCUMENTS

| | | | | |
|---|---|---|---|---|
| 4,874,536 | A | 10/1989 | Strickland, Jr. et al. | 252/90 |
| 2002/0198120 | A1 | 12/2002 | Koduvely et al. | 510/141 |

FOREIGN PATENT DOCUMENTS

| | | | |
|---|---|---|---|
| DE | 31 04 371 | | 11/1982 |
| GB | 2 021 143 | | 11/1979 |
| GB | 2 142 341 | | 1/1985 |
| GB | 2142341 | * | 1/1985 |
| WO | 93/02168 | | 2/1993 |
| WO | 96/06916 | | 3/1996 |
| WO | 96/06917 | | 3/1996 |
| WO | 97/32005 | | 9/1997 |
| WO | 97/39100 | | 10/1997 |
| WO | 00/18869 | | 4/2000 |

OTHER PUBLICATIONS

GB Search Report in a GB application GB 0228585.6—May 29, 2003.
Co-pending U.S. Appl. No. 10/726,739, filed Dec. 3, 2003, Applicant: Casey et al.
GB Search Report in a GB application GB 0228584.9—Jun. 12, 2003.
PCT International Search Report in a PCT application PCT/EP 03/12242.
PCT International Search Report in a PCT application PCT/EP 03/12231.
Japanese Abstract JP 09 338583—published Jun. 29, 1999.
Derwent Abstract of DE 31 04 371—published Nov. 11, 1982.

* cited by examiner

*Primary Examiner*—Necholus Ogden
(74) *Attorney, Agent, or Firm*—Rimma Mitelman

(57) ABSTRACT

An anionic surfactant particle for use in laundry detergent compositions has an anionic surfactant content of at least 95 wt % of anionic surfactant and comprises linear alkylbenzene sulphonate (LAS) and primary alcohol sulphate (PAS) in a weight ratio of from 5:1 to 1:3. The particle, which is preferably in the form of a flake, is of low hygroscopicity and dissolves rapidly in water.

8 Claims, No Drawings

DETERGENT COMPOSITIONS

TECHNICAL FIELD

The present invention relates to anionic surfactant particles of high surfactant content, suitable for incorporation in particulate laundry detergent compositions.

BACKGROUND AND PRIOR ART

Anionic surfactants, particularly the sulphonates such as linear alkylbenzene sulphonate (LAS) and the sulphates such as primary alkyl sulphate (PAS), are the key ingredients of modern laundry detergents, providing excellent detergency performance on a wide range of soils and stains.

For optimum performance, especially in the handwash or in top-loading washing machines where foaming is not a problem, it is desirable to provide a high level of such anionic surfactants in the powder. However, the amount that can be incorporated may be limited by process and powder property requirements.

Most laundry detergent powders, whether of high or low bulk density, contain a "base powder" consisting of composite granules of surfactant and inorganic builder (and other) salts, prepared either by spray-drying a slurry in a spray-drying tower, or by mixing and granulation (non-tower processing) in a high-shear mixer/granulator. Other lesser ingredients that are sufficiently robust to survive these processes may also be contained in the base granules, while more sensitive ingredients such as bleaches and enzymes are subsequently admixed ("postdosed").

Surfactants are mobile organic materials and the amount that can be incorporated in a base powder, whether spray-dried or non-tower granulated, without causing processing difficulties, and products with poor flow and stickiness, is limited. It is therefore known to top up the anionic surfactant content of laundry powders by postdosing high-active anionic surfactant granules.

High active surfactant granules are disclosed, for example, in WO 96 06916A and WO 96 06917A (Unilever). These granules are prepared by flash drying. LAS granules prepared by this route typically contain up to 80 wt % LAS, together with a salt such as zeolite or sodium tripolyphosphate. Granules without salt may be prepared, but are highly hygroscopic. PAS granules may contain up to 100 wt % PAS without developing hygroscopicity problems, but PAS does not have the robust detergency profile of LAS across a wide range of wash conditions.

The present inventors have now found that a composite particle of LAS and PAS containing little or no inorganic salt can be prepared which combines low hygroscopicity with an excellent detergency profile. This particle is very useful in the formulation of a range of high-active solid detergent products.

DEFINITION OF THE INVENTION

The present invention provides an anionic surfactant particle for use in a laundry detergent composition, the particle having a total anionic surfactant content of at least 95 wt % and comprising linear alkylbenzene sulphonate (LAS) and primary alcohol sulphate (PAS) in a weight ratio of from 5:1 to 1:3.

The invention also provides processes for preparing the particle and detergent compositions incorporating it.

DETAILED DESCRIPTION OF THE INVENTION

The Anionic Surfactant Particle

The anionic surfactant particle of the invention has a very high surfactant content: at least 95 wt %, and preferably at least 98 wt %. Most preferably, the surfactant content is 100 wt %.

The weight ratio of LAS to PAS in the particle is within the range of from 5:1 to 1:3, preferably from 3:1 to 1:2.

The particle preferably does not contain more than 2 wt % of inorganic salts. It is most preferably substantially free of inorganic salts.

LAS and PAS are of course well known to all detergent formulators. The LAS preferably has an average alkyl chain length of from $C_8$ to $C_{15}$. The PAS preferably has an average alkyl chain length of $C_8$ to $C_{20}$, more preferably from $C_{10}$ to $C_{16}$, and most preferably from $C_{12}$ to $C_{14}$.

Both anionic surfactants are preferably in sodium salt form.

The anionic surfactant particle of the invention may be of any suitable particulate form, for example, granules, pellets, or flakes. Flakes are especially preferred.

Preparation of the Anionic Surfactant Particle

The anionic surfactant particles may be prepared by any suitable process.

One suitable process comprises the steps of (i) reacting LAS acid with sodium carbonate to form sodium LAS and water, (ii) admixing PAS in any suitable form, (iii) drying the resulting mixture to a solid form, and (iv) comminuting to form particles.

Suitable drying processes include freeze drying, drum drying and oven drying.

Detergent Compositions

As previously indicated, the anionic surfactant particle of the invention may be used as an ingredient of high-active particulate laundry detergent compositions.

Thus, a further subject of the present invention is a particulate detergent composition comprising an anionic surfactant particle as defined above, in admixture or conjunction with one or more other solid detergent ingredients.

According to a preferred embodiment of the invention, the anionic surfactant particle is admixed or "postdosed" to a detergent composition containing a conventional base powder (composite surfactant/builder granules) in order to increase the total surfactant content. Therefore, a preferred detergent composition according to the invention comprises:

(a) a base powder composed of composite granules comprising surfactant and builder, (b) anionic surfactant particles as defined above, (c) optionally postdosed detergent ingredients.

The detergent base powder may itself contain LAS and/or PAS, and/or other anionic surfactants.

Other anionic surfactants include alkyl ether sulphates; olefin sulphonates; alkyl xylene sulphonates; dialkyl sulphosuccinates; and fatty acid ester sulphonates. Sodium salts are generally preferred.

Preferably the composition contains, in total, at least 20 wt % anionic surfactant, more preferably at least 25 wt % anionic surfactant. Use of the anionic surfactant particles of the present invention allows products containing levels of total anionic surfactant of 30 wt % and above.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising anion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The list of surfactants is not intended to be exhaustive and the use of any surfactant suitable for incorporation in particulate laundry detergent compositions falls within the scope of the present invention.

The detergent compositions of the invention also contain one or more detergency builders. The total amount of detergency builder in the compositions will suitably range from 5 to 80 wt %, preferably from 10 to 60 wt %.

Preferred builders are alkali metal aluminosilicates, more especially crystalline alkali metal aluminosilicates (zeolites), preferably in sodium salt form.

Zeolite builders may suitably be present in a total amount of from 5 to 60 wt %, preferably from 10 to 50 wt %.

The zeolites may be supplemented by other inorganic builders, for example, amorphous aluminosilicates, or layered silicates such as SKS-6 ex Clariant.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Alternatively, the compositions of the invention may contain phosphate builders, for example, sodium tripolyphosphate.

These lists of builders are not intended to be exhaustive.

Especially preferred organic builders are citrates, suitably used in amounts of from 1 to 30 wt %, preferably from 2 to 15 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Detergent compositions according to the invention may suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %.

Sodium silicate may also be present. The amount of sodium silicate may suitably range from 0.1 to 5 wt %.

Powder flow may be improved by the incorporation of a small amount of a powder structurant. Examples of powder structurants, some of which may play other roles in the formulation as previously indicated, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; foam boosters or foam controllers as appropriate; fluorescers; enzymes (for example, proteases, lipases, amylases, cellulases); dyes; coloured speckles; perfumes; and fabric conditioning compounds.

Subject to compatibility and processing restraints, some of these materials may be incorporated in the base powder, while others are more suitably present as separate postdosed ingredients.

EXAMPLES

The invention is further illustrated by the following non-limiting Examples in which parts and percentages are by weight unless otherwise stated.

Example 1

Preparation of 1:1 LAS/PAS Flakes

The starting materials were as follows:

| | |
|---|---|
| LAS acid (Petrelab (Trade Mark) Q ex Ballestra) | 30.0 g |
| Sodium carbonate | 7.7 g |
| Sodium dodecyl sulphate (SDS ex Sigma) | 30.0 g |

The LAS acid was reacted with the sodium carbonate. On completion of the neutralisation reaction, the sodium dodecyl sulphate was admixed. The resulting mixture was oven dried at 80° C. to form thin sheets which were cut into flakes.

The content of the flakes was as follows:

| | weight % |
|---|---|
| Sodium LAS | 48.9 |
| Sodium PAS (SDS) | 45.0 |
| Sodium carbonate | 4.8 |
| Water | 1.2 |

The weight ratio of LAS to PAS was approximately 1:1.

Example 2

Preparation of 3:1 LAS/PAS Flakes

By the same method, flakes having a LAS:PAS weight ratio of approximately 3:1 were prepared.

The amounts of starting materials used were:

| | |
|---|---|
| LAS acid (as Example 1) | 32.6 g |
| Sodium carbonate | 6.0 g |
| SDS | 10.0 g |

and the composition of the flakes was as follows:

| | weight % |
|---|---|
| Sodium LAS | 73.0 |
| Sodium PAS (SDS) | 22.0 |
| Sodium carbonate | 3.3 |
| Water | 1.8 |

Hygroscopicity Measurements

The water uptake of the flakes of Examples 1 and 2 were compared with those of the following controls:

Comparative Example A: pure LAS flakes ex Huntsman

Comparative Example B: pure SDS (powder)

Comparative Example C: LAS/zeolite granule (3:1) prepared by flash drying as described in WO 96 06916A (Unilever).

The samples were placed in a cabinet at 20° C. and 50% relative humidity and the water uptake of each was measured after 3 weeks.

The results were as shown in the following Table.

| Example | Water uptake (wt %) | State of sample after 3 weeks |
|---|---|---|
| 1 | 3.3 | dry, stable flakes |
| 2 | 5.1 | dry, stable flakes |
| A | 7.3 | transformed into soft solid |
| B | 2.0 | dry, stable flakes |
| C | 13.2 | damp granules |

Dissolution Measurements

Dissolution times were measured by a conductivity method, as follows.

A 3-liter beaker was filled with 1.5 liters of deionised water at room temperature, and stirred with a stirrer rotating at 500 revs/minute. 0.7 grams of the sample under test were added. The conductivity of the resulting solution was measured using a conductivity probe fixed near to the wall of the beaker. The conductivity was recorded on a chart recorder that tracked the change in conductivity over time.

The following table shows $t_{90}$ values (the time for 90 wt % dissolution to take place).

| Example | $t_{90}$ (seconds) |
|---|---|
| 1 | 176 |
| 2 | 217 |
| A | 35 |
| C | 80 |

The invention claimed is:

1. An anionic surfactant particle for use in a laundry detergent composition, the particle having a total anionic surfactant content of at least 95 wt % and consisting of linear alkylbenzene sulphonate (LAS) and primary alcohol sulphate (PAS) in a weight ratio of from 5:1 to 1:3, sodium carbonate, and water.

2. An anionic surfactant particle as claimed in claim 1, having a total anionic surfactant content of at least 98 wt %.

3. An anionic surfactant particle as claimed in claim 1, wherein the ratio of LAS to PAS is within the range of from 3:1 to 1:2.

4. An anionic surfactant particle as claimed in claim 1, wherein the PAS has an average alkyl chain length within the range of from $C_{10}$ to $C_{16}$, preferably from $C_{12}$ to $C_{14}$.

5. An anionic surfactant particle as claimed in claim 1, wherein the anionic surfactants are in sodium salt form.

6. An anionic surfactant particle as claimed in claim 1, which is the form of a flake.

7. A particulate detergent composition which comprises (a) a base powder composed of composite granules comprising surfactant and builder, (b) anionic surfactant particles as claimed in claim 1, (c) optionally postdosed detergent ingredients.

8. A particulate detergent composition as claimed in claim 7, having a total anionic surfactant content of at least 20 wt %.

* * * * *